US007306227B2

(12) United States Patent
Kenney

(10) Patent No.: US 7,306,227 B2
(45) Date of Patent: Dec. 11, 2007

(54) GAME WITH PATH-INTERSECTING DISRUPTOR

(75) Inventor: Tyler Kenney, Hawthorne, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/177,603

(22) Filed: Jul. 6, 2005

(65) Prior Publication Data

US 2006/0027962 A1 Feb. 9, 2006

Related U.S. Application Data

(60) Provisional application No. 60/598,946, filed on Aug. 4, 2004.

(51) Int. Cl.
*A63F 3/00* (2006.01)

(52) U.S. Cl. ..... 273/243; 273/287

(58) Field of Classification Search ..... 273/243, 273/249

See application file for complete search history.

(56) References Cited

U.S. PATENT DOCUMENTS 1,223,859 A 4/1917 Doan
4,062,545 A * 12/1977 Witney ..... 273/239
4,125,262 A 11/1978 Erickson
4,128,246 A * 12/1978 Hicks et al. ..... 273/243
4,192,512 A 3/1980 Erickson et al.
4,206,925 A 6/1980 Goldfarb et al.
4,225,138 A 9/1980 Wolf
4,248,028 A 2/1981 Dardaine
4,333,655 A 6/1982 Rudell et al.
4,824,117 A 4/1989 Russell
4,852,886 A 8/1989 Zaruba et al.
4,893,819 A 1/1990 Wright
5,129,655 A 7/1992 Gillespie et al.
5,531,447 A 7/1996 Nagasaka et al.
5,540,439 A 7/1996 Kamentsky
6,669,197 B1 12/2003 Lund et al.
2003/0085519 A1 5/2003 Bedford

* cited by examiner

*Primary Examiner*—Vishu Mendiratta
(74) *Attorney, Agent, or Firm*—Kolisch Hartwell, et al.

(57) ABSTRACT

A game may include a game board having a player-piece pathway of connecting player-piece spaces, and a plurality of player pieces. In some examples, the game board may include a disruptor pathway extending through one or more player-piece spaces, and the game may further include a disrupter adapted to travel along the disruptor pathway.

20 Claims, 4 Drawing Sheets

Fig. 3
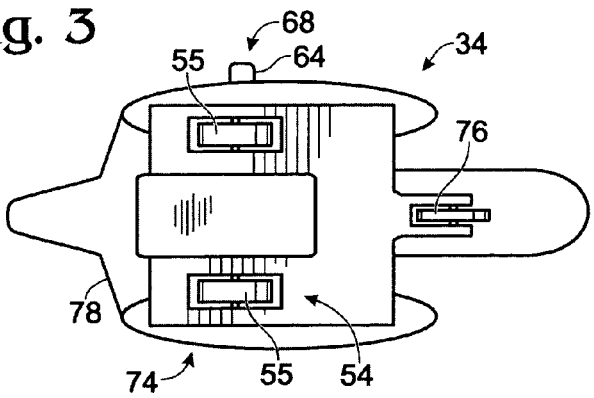
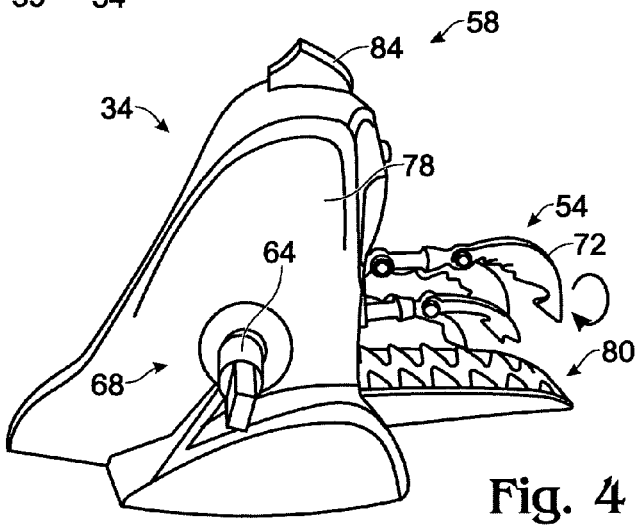
Fig. 4
Fig. 5
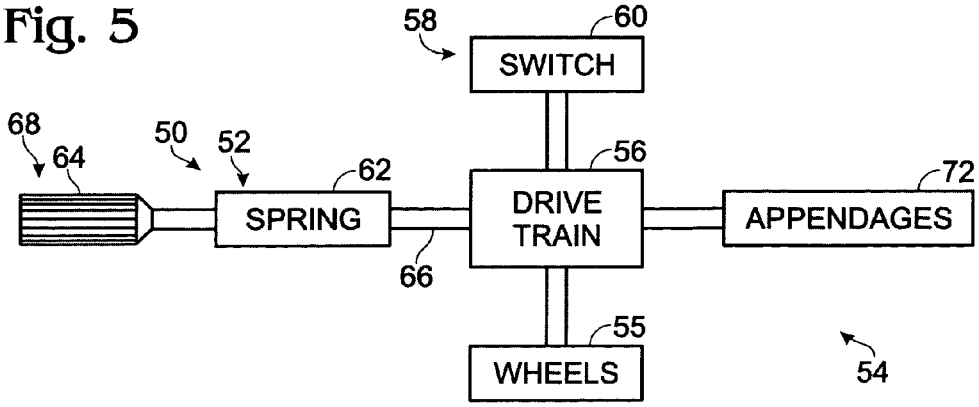

GAME WITH PATH-INTERSECTING DISRUPTOR

CROSS REFERENCE TO RELATED APPLICATIONS

The present application claims priority from U.S. Provisional Patent Application Ser. No. 60/598,946, filed Aug. 4, 2004, and incorporated herein by reference in its entirety for all purposes.

BACKGROUND

The present disclosure relates generally to board games, and more specifically to board games where players collect tokens to accumulate points. Some games include a disruptor, which may be a device that disrupts, physically or pursuant to game rules, progress of player pieces along a player-piece pathway. Examples of pathway collection games and games with disruptors may be found in patents and patent applications numbered: U.S. Pat. Nos. 1,223,859; 4,125,262; 4,192,512; 4,206,925; 4,225,138; 4,333,655; 4,348,028; 4,824,117; 4,852,886; 4,893,819; 5,129,655; 5,531,447; 5,540,439; 6,669,197; US2003/0085519, the disclosures of which are incorporated herein by reference.

SUMMARY OF THE DETAILED DESCRIPTION

A game may include a game board having a player-piece pathway of connecting player-piece spaces, and a plurality of player pieces. In some examples, the game board may include a disrupter pathway extending through one or more player-piece spaces, and the game may further include a disruptor adapted to travel along the disruptor pathway.

BRIEF DESCRIPTION OF THE DRAWINGS

FIG. 3 is a bottom view of a disrupter shown in FIG. 1.

FIG. 4 is a side perspective view of the disruptor shown in FIG. 1.

FIG. 5 is a block diagram of the disruptor shown in FIG. 1.

DETAILED DESCRIPTION OF ONE OR MORE EMBODIMENTS

A game may include a game board having a player-piece pathway of connecting player-piece spaces, and a plurality of player pieces. In some examples, the game board may include a disruptor pathway extending through one or more player-piece spaces, and the game may further include a disruptor adapted to travel along the disruptor pathway. In some examples, a plurality of players may move their playing pieces about a game board, earning points by collecting tokens, such as game cards. The first player to collect a pre-determined award(s), such as an amount or value of tokens, may be declared the winner of the game. In some examples, the goal of the players may be to collect tokens while avoiding a disruptor that may move along the game board.

In one example, a game may include a game board having a player-piece pathway of connecting player-piece spaces and a disrupter pathway extending through at least one set of a plurality of contiguous player-piece spaces. Players may use a plurality of distinctive player pieces. In some examples, at least one disruptor may be adapted to travel along the disruptor pathway. A game 10 illustrated in the various figures may be adapted to provide such a game. Game 10 may be configured in many different ways, and may incorporate elements and features of a particular theme, such as a popular cultural phenomenon, such as a book or movie. In such a case, the elements or game 10 may include depictions, shapes, and colors that reflect or exemplify this theme or phenomenon. In the example illustrated, game 10 is based on the movie *Robots The Movie,* produced by Twentieth Century Fox Film Corporation.

Figure 1:
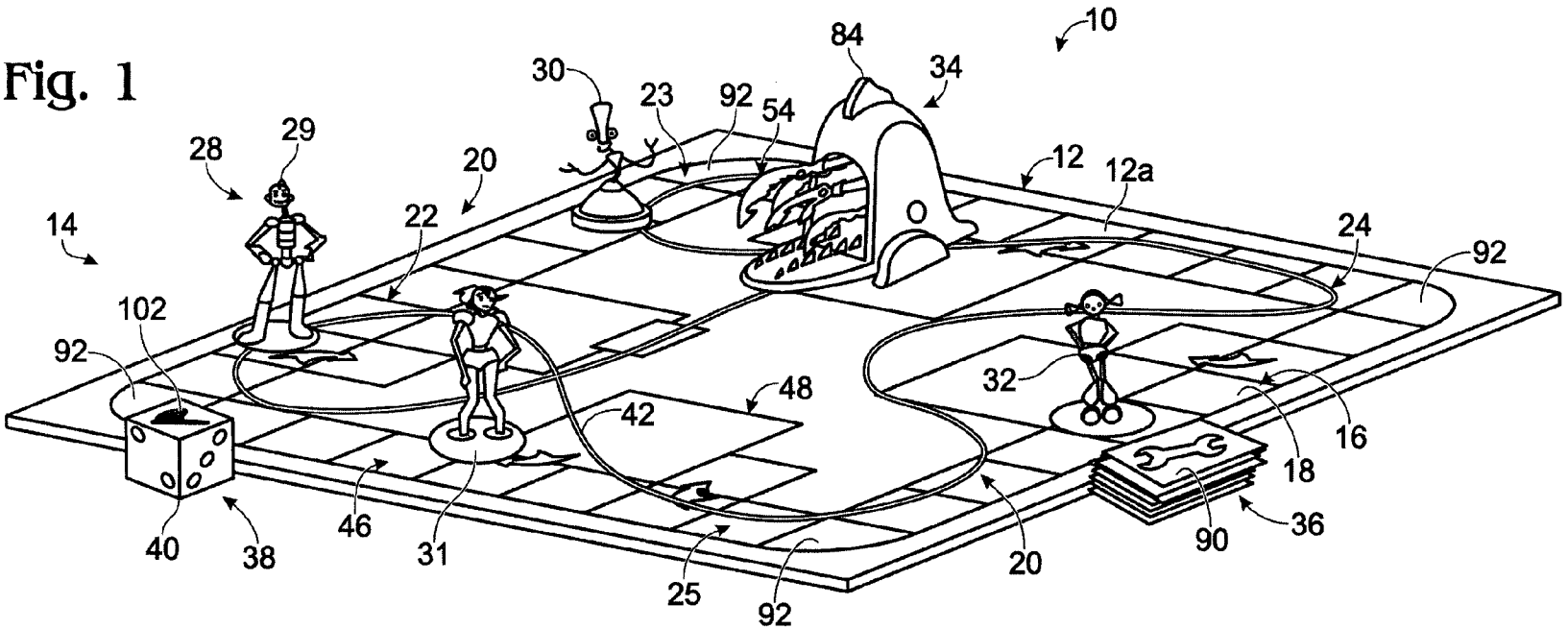
FIG. 1 is an isometric view of a game board and game components.

In particular, FIG. 1 is a perspective view of game 10 including a game board 12 and game components 14. In some examples, the game board may have a surface 12*a* on which indicia defines a player-piece pathway 16. The game board and/or pathway may also be three-dimensional in form. Pathway 16 may extend along a stretch of the game-board surface and include a plurality of player-piece spaces 18. In some examples, the game board may also contain a disruptor pathway 20. Disruptor pathway 20 may extend along, adjacent to, or through all or part of player-piece pathway 16. In this example, disruptor pathway 20 extends through continuous stretches of the player-piece pathway, such as through sets 22, 23, 24 and 25 of contiguous (serially adjacent) player-piece spaces 18.

The game components 14 may vary depending on the nature of the game and the rules used to play it. In this example, the components may include a plurality of player pieces 28, such as player pieces 29, 30, 31 and 32, a disruptor 34, awards 36, and a player-piece-advancement mechanism 38, such as a die 40. Disruptor 34 may be adapted to move along disrupter pathway 20 during portions of game play. Disruptor 34 and disruptor pathway 20 may be adapted to limit movement of the disruptor to movement along the disruptor pathway. For example, pathway 20 may be a track 42 (seen in more detail in FIG. 2), such as a groove 44 in the game board, along which a moving disrupter may travel. Other forms of pathway 20 may also be used. The disruptor pathway and the disruptor may be adapted to limit travel of the disruptor to travel along the disruptor pathway. For example, the disrupter may have an optical tracker that optically follows a line on the game board, or one or more ridges or rails may extend along the game board.

Figure 2:
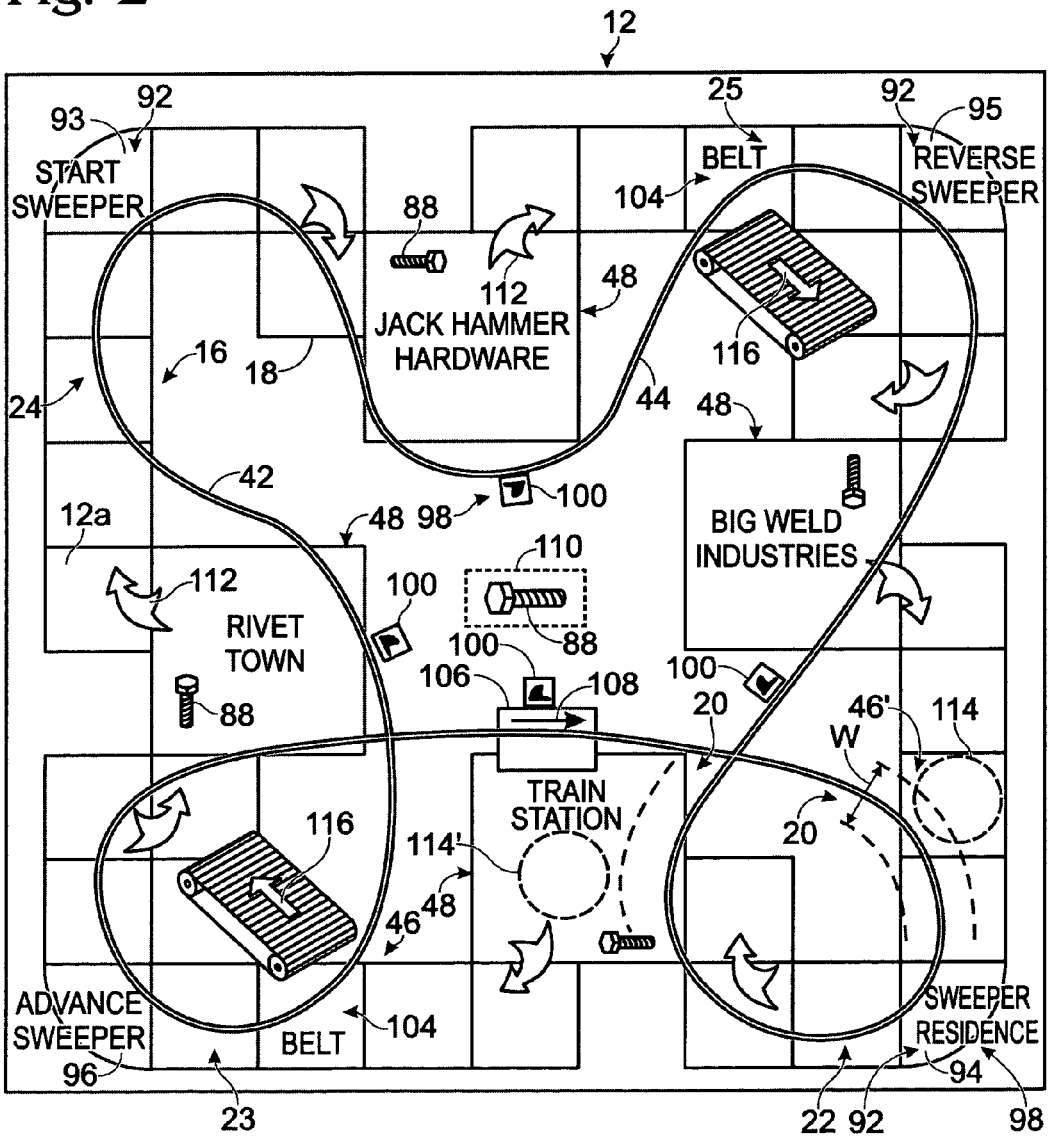
FIG. 2 is a plan view of the game board of FIG. 1.

FIG. 2 shows an example of a game board 12 in more detail. Player-piece spaces 18 may be arranged to form player-piece pathway 16 as a continuous pathway. The game board 12, thus, includes the playing surface 12*a,* player-piece pathway 16 and disruptor pathway 20.

The plurality of player-piece spaces on the playing surface of the game board may be arranged along pathway 16 in any desired configuration. In this example, pathway 16 generally follows the periphery of playing surface 12*a.* The player-piece spaces of the player-piece pathway may have the same appearance, a variety of appearances, or each may have a distinct appearance, such as a distinct color. In the example illustrated, two adjacent player-piece spaces do not have the same color. The colors, tones and/or hues of the player-piece spaces may be chosen from, but not be limited to, the following list of base colors: white, red, orange, green, navy blue, blue, black, and purple. The player-piece spaces may be of different sizes and shapes. As shown, peripherally disposed player-piece spaces 46 may be abutted at some locations by spaces 48 of a different size and/or shape. The differently sized spaces 48 may be located toward the interior of the game board, relative to the positions of player-piece spaces 46. The differently sized spaces 44 may be shaped larger or smaller than spaces 46, but in a preferred embodiment the differently sized spaces are of larger dimensions than player-piece spaces 46. Together, there may be about 40 larger and smaller spaces making up pathway 16.

Disruptor pathway 20 may be of any configuration appropriate for the game played. In this example, pathway 20 is circuitous and meanders around the game board surface, intersecting in places with pathway 16. Pathway 20 may intersect with all of the player-piece spaces, or with a portion or portions of the player spaces. The circuitous pathway may have branches and may also intersect with itself at a number of locations; in this case, the circuitous pathway may form loops. In addition, the circuitous track 42 may be etched, cut, or otherwise formed on or into the surface of the game board 12 so that a moving disrupter 34 may follow that track with ease (as described further below). In this example, the circuitous track 12 is looped and intersects approximately half of the player-piece spaces 18 in sets 22-25 of player-piece spaces. During play, a player piece may move sequentially along a plurality of adjacent, contiguous player-piece spaces through which the disruptor pathway extends.

The player-piece pathway 16 and track 42 make up locations where player pieces 28 and disrupter 20, respectively, may be placed during play of the described game. The player pieces of the game may be assigned as one for each person playing the game. The maximum number of players of the described game may be limited by the number of available player pieces. The player pieces 28 of the described game may be of any suitable form, and may include, but not be limited to, the following characters: Rodney Copperbottom™, Piper, Fender, and Crank. Each of the movers may be a static figure of different shape, or design, indicia or color, such that they can be distinguished one from the other. Some examples of player pieces of the described game may be seen in FIG. 1. While each player of the game may control their own player piece 28, the players may share control of a moving disrupter 20.

Disruptor 34, which in this example of the game may also referred to as a "Sweeper", may be controlled at various times by each of the players of the game, and/or it may or may not be assigned permanently to any one player in particular. The disruptor may take the form of a character that travels around the game board on the looping, circuitous track, occasionally intersecting pathway 16 of player-piece spaces followed by the player pieces 28. The disrupter may be activated at distinct times by the players, and may move around the board, potentially colliding with player pieces located on player-piece spaces contained within one of sets 22-25 of player-pieces.

Figure 6:
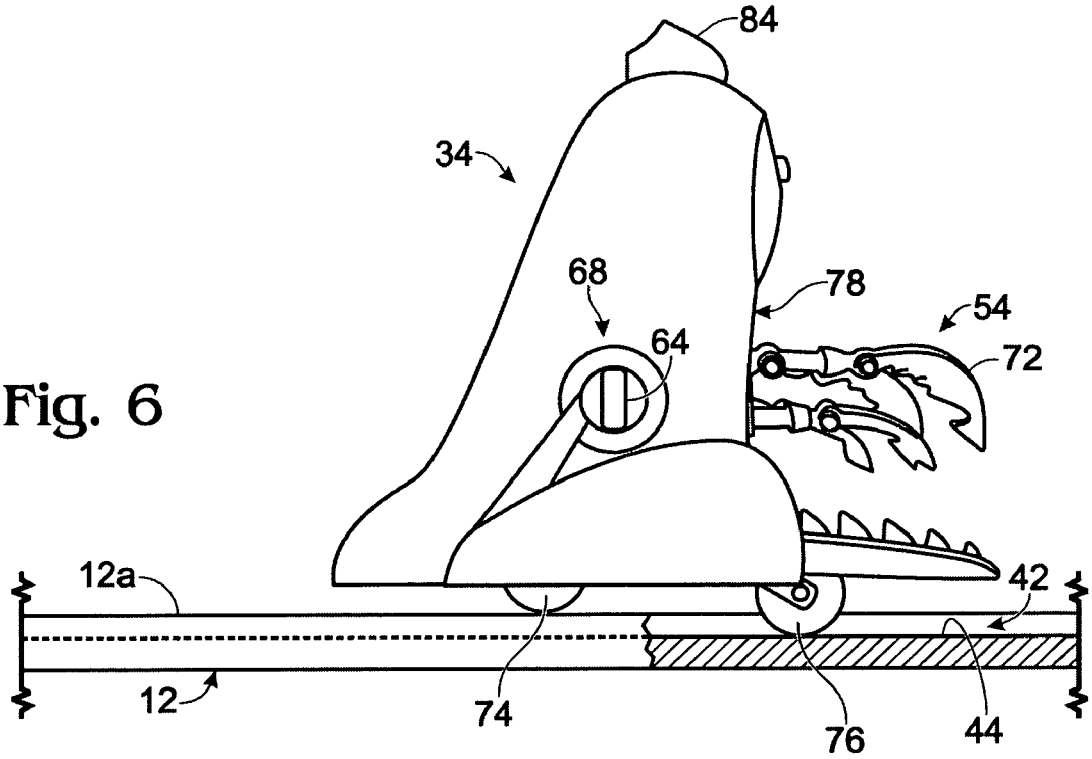
FIG. 6 is a side view of the disruptor shown in FIG. 1 in position on the game board of FIG. 1.

The disruptor 34 depicted as the "Sweeper" may be seen in position on track 42 in FIG. 1. Various views of disrupter 34 are shown in FIGS. 3-6. In FIG. 3, a portion of the bottom of the disruptor is shown. A side view of the disrupter is shown in FIG. 4. A block diagram of the functional parts of this example of a disrupter is shown in FIG. 5. FIG. 6 shows a side view of a lower portion of the disrupter.

Referring to FIG. 5, an example of a disruptor may include a propulsion mechanism 50, such as a motor 52 drivingly coupled to one or more moving elements 54, such as wheels 55, by a drive train 56. Optionally, propulsion mechanism 50 may include one or more controls 58, such as a switch 60 for starting and stopping motor 52. Motor 52 may be of any suitable type. An example is an electric motor powered by resident batteries or a remote power supply. In the present example, motor 52 includes a mechanical spring 62, manually wound by a knob 64, that applies a rotational force to a shaft 66. A winding device 68 allows for manually winding of the spring. Shaft 66 then drives drive train 56, which may be in the form of a gear assembly, drivingly connected to set 54 of wheels.

Disruptor 34 also may include one or more other types of moving elements 54 that may be caused to move by propulsion mechanism 50 or another propulsion mechanism. In this example, elements 54 may include appendages 72 that extend from a disruptor body, as is described further below. Other types of movable elements may also be provided, such as arms, head, legs, eyes, tails, propellers, wings, or the like. Other configurations providing for movement of a disruptor on the game board may be used. Optionally, no propulsion mechanism may be provided to move the disruptor, in which case the disrupter may be moved manually either along a disruptor pathway or between designated disruptor positions, such as disruptor spaces.

Referring to FIG. 3, a bottom view of disrupter 20 is shown. Wheels 55 may include one or more drive wheels 74 and one or more guide wheels, such as guide wheel 76. Additional wheels, skids or other supports, such as a freely rotating wheel, may also be provided. Optionally, another form of drive element may be used, such as a drive belt, articulated legs, a spinning propeller, moving feet or the like. As shown in FIG. 6, guide wheel 76 may be constructed to have a lower edge positioned lower than the lower edges of the other wheels, and sized such that it may fit into groove 44 on the game board. Thus, at least one of the wheels or other guide element of the disruptor may fit into groove 44, and the movement of the disrupter, as it rolls along on the full set 54 of wheels 55, will be guided by that groove. The wheels and the lower portion of the disruptor may serve as support for a main body 78 of the disruptor, which may or may not contain a separate motor.

As seen in FIG. 4, main body 78 of the disruptor may have an elongated upright appearance, and the main body may provide support for various moving elements 54, such as appendages 72. The appendages 72 in this example of the disruptor may project from the disruptor's body, and they may take on a hook-like shape at the end of one or more of the appendages 72 distal from the disruptor's body 78. For example, the hook-like appendages may project from the front of the disruptor's body, such as from an opening 80, representing a "mouth" of the "Sweeper". The appendages may be fixed in position relative to the disruptor body, or one or more of them may perform active movements. Such movements may occur when the disruptor is sitting still or as the disruptor travels along track 42. For example, the appendages 72 may move in and out of opening 80, or mouth, of the disruptor, or they may move up and down in the opening. Alternatively, they may move with a combination of in-and-out and/or up-and-down motions, driven, for example with a cam mechanism included in gear train 68. In addition to providing support for the appendages, the main body 78 of the disrupter may contain propulsion mechanism 50 to provide movement to the appendages 72 and/or the disruptor itself. Other suitable shapes and configurations of a disruptor may be used.

As mentioned, wind-up motor 52 may be positioned within the body 78 of the disrupter, and associated winding device 68 may extend through one side of the disruptor body. An end of the winding device 68 is in the form of knob 64 used for manually winding up motor 52. Turning the knob may tighten spring 62. Release of the tension within the spring by turning of shaft 66 may provide the energy necessary for movement of the disruptor and its associated parts. Once the spring in the motor is wound, depression or other movement of a start and/or stop button 84 connected to switch 60 and mounted on disruptor body 78, may be sufficient to release the energy applied by the spring through drive train 56, turning drive wheels 74, and moving the disruptor.

The start and/or stop button 84, as part of propulsion mechanism 50, may provide for conservation of the energy stored in the spring of the motor after it is wound, in addition to allowing the disruptor to begin its movement. For example, if the motor still is propelling the disruptor 34 along the circuitous track 42 after the disruptor has completed a full circuit of that track, then depressing the start and/or stop button 84 may halt the disruptor's movement and allow residual energy in the motor to be conserved for the next time the disruptor is moved. This may obviate the need to wind up the motor before every release of the disruptor on the game board. The start and/or stop button 84 may also provide for some control over the length of time of the disruptor's movement should it be desired for the disrupter to complete less than a full circuit of the track. That is, the disruptor's progress along the track 42 may be terminated by movement of the start/stop button. Optionally, the spring may be wound a variable amount determined by the player, so the disruptor stops due to complete unwinding of the spring after traveling a distance determined by the amount the spring was wound up.

As noted above, game play with the game of the present disclosure has as its object travel about the game board 10 for the purpose of collecting awards 36, such as tokens or points, while avoiding the movement of the disruptor 34 along its track. As has been described, the game board 12 may contain a player-piece pathway 16 composed of a number of player-piece spaces 18 including smaller spaces 46 and larger spaces 48, and a circuitous disrupter track 42 defining a disruptor pathway 20. To create a richer play environment, one or more of the player-piece spaces 18 may carry labels or images marking them as different sites that are part of a city in which character player pieces might reside. These locations might include, for example, but not be limited to: the Chop Shop; Jack Hammer's Hardware; Big Weld Industries; Rusty's Alleyway; Rivet Town; and Train Station. For example, larger player-piece spaces 48 are shown with some of these city site names. Interspersed among or located on these city sites may be award icons 88, depicted as text and/or image, and award spaces. For example, an award icon 88 may be for Spare Parts, such as represented by the image of a bolt. The game players may move their character player pieces along the pathway 16 among these various city sites on spaces 48 as they visit the Spare Parts icons in an attempt to collect awards 36 in the form of Spare Part cards 90 by landing on or passing through a designated player-piece space 48. The awards may be the cards themselves, values indicated on the cards, or images on the cards, such as different spare parts.

In addition to the city sites, the game board 12 may have player-piece spaces 92 or path locations relating to the disrupter 34. These special locations 92 may include: a "Sweeper Start" space 93; a "Sweeper Residence" space 94; a "Reverse Sweeper" space 95; and an "Advance Sweeper" space 96. These special locations may exist on both the disruptor track and playing path, and may be landed upon by the character player pieces 28 of any of the players. By landing on one of these spaces, the player may modify the activity of the disruptor in some manner, such as through starting, stopping, advancing, or reversing the disruptor, or moving the disruptor to a predetermined location, such as disruptor residence locations 98 indicated by disruptor icons 100.

As has been mentioned, to facilitate movement about the game board 12, and to enhance play value, the game may come with a multi-sided die 40 or other advancement mechanism 38. Additionally or alternatively, for example, the game board may contain special "advancement spaces" or other form of number generator, not shown. The die 40 may be used to direct the movements of the player pieces or of the disruptor. For example, a 6-sided die 40 may have the standard numbers 2 through 6 on five of its sides, but have a disruptor icon 102 in place of the standard number 1. In this manner, rolling the modified die could be used to advance the player pieces 28 a defined number of spaces, or it could be used to signal that the disrupter should be activated and set in motion upon its track 42.

Specialized advancement spaces 104 may be used to advance rapidly the player pieces 28 and/or the disruptor 20 in forward and/or reverse directions. For example, the specialized advancement spaces 104 may take the form of "conveyor belt" spaces. The conveyor belt spaces may serve to advance the player pieces forward more spaces than could be moved after a roll of the die 40. Alternatively, the conveyor belt spaces may serve to move the player pieces 28 in a reverse direction, relative to their direction of travel.

It will be appreciated, then, that game 10 is also an example of a game that may include a game board having a continuous player-piece pathway of connecting player-piece spaces including a plurality of award spaces, and a disruptor pathway having a continuous groove extending through a plurality of spaced-apart sets of contiguous player-piece spaces. In some examples, the game may further include a plurality of distinctive player pieces, and a disruptor adapted to move along the disrupter pathway with a guide element positioned in the groove, the disruptor being adapted to be positioned on the disruptor pathway for movement along the disruptor pathway in either of two opposite directions, and to contact a player piece located on one of the player-piece spaces in one of the sets of player-piece spaces. In some examples, a game may include a plurality of awards associated with the award spaces. Additionally or alternatively, a disrupter, a plurality of player pieces, and player-piece spaces in sets of player-piece spaces, may be configured so that the disruptor traveling along the disruptor pathway contacts a player piece positioned within a player-piece space in one of the sets of player-piece spaces.

Game 10 may be played in a variety of ways according to rules that may be agreed upon by the players. The following is an example of rules that may be used to set up and play the game illustrated.

Set-up of the game may be accomplished by each player selecting a Robot™ character as their player piece. Each player may then place their player piece on a player-piece space 18, such as on a defined city site 48, with each player piece being on a different city site. In a 2-player game, the two players may place their player pieces in city sites on opposite sides of the game board 12.

The disrupter 34 may be set up by placing it in its track 42 and setting the start/stop button 84 on the disrupter body to the "stop" position. The initial position of the disruptor may be defined by a "Sweeper home" or Start Space 106 (FIG. 2). Additionally, the disruptor's motor may be wound by turning the winding device 68 connected to the motor. Finally, the disruptor may be oriented such that it begins the game at the disruptor Start Space 106 and its initial movement will be in a designated direction, such as in a counterclockwise direction around the game board; which direction may be indicated by an arrow 108 printed on the surface of the game board.

Set-up of the game may be completed by the placement of Spare Parts tokens and/or cards 90 upon the game board surface. The tokens may have different values indicated on one side of each token. The Spare Parts tokens 90, in the form of cards, may be shuffled into a pile, in a manner devised to make their distribution in that pile a random distribution, and then that pile placed at a particular site 110 on the game board 10 indicated by the award icon 88. The Spare Parts tokens 90 may be placed onto a Spare Parts icon on the game board, with the pile of tokens oriented such that the point values of the various tokens are hidden from view.

Once set-up of the game is completed, game 10 may be played following a set of rules designed to enhance play. These rules may dictate: the order of play; how player pieces may be moved around the board; actions followed at specific spaces; and operation of the disrupter.

Play may be initiated in various ways. One way is to have the youngest player begin the game. Further game play may proceed in an ordered fashion, such as having the next player seated at the board, in a clockwise direction relative to the previous player, go next. Turns may proceed around the board in this manner, with each next player being seated in a clockwise direction from the previous player, throughout the course of the game. When it is a player's turn, that player may roll the die 40 to determine the action to be made upon the game board; the number or icon showing on the uppermost face of the die 40 may determine the next move to be made by the player rolling the die. The indicia showing on the uppermost face of a rolled die may determine whether the player moves their player piece 28 or if they move the disruptor 34.

Rolling the die 40 and having a number come up on the uppermost face of the die may mean that the player advances their player piece 28 forward the displayed number of spaces. For example, if the number "5" were on the uppermost face, then the player would move their player piece 5 spaces forward, where "forward" may be defined as movement in a clockwise or counterclockwise direction along the pathway of player-piece spaces; colored arrows, such as arrow 112, printed on the surface of the game board may also denote the forward direction. When a player piece 28 is advanced to a new player-piece space 18 on the pathway 16, it may be placed in that location so that the entire base 114 (the bottom support of the mover), as represented by dashed circle in FIG. 2, resides within the player-piece space. If it happens that the player piece 28 of a first player is to be placed on a player-piece space that is already occupied by the player piece 28 of a second player, then the player piece 28 of the first player may be placed on the next space available in a forward direction. The space upon which a player piece 28 may land can be a typically colored space (as described above) or it may be a special space.

Special spaces on the game board may take several forms. Special spaces may include larger spaces 48 corresponding to City Sites, advancement spaces 104 represented as Conveyor Belts 104, Reverse Sweeper spaces 95, Advance Sweeper spaces 96, Sweeper Start space 93, and Sweeper Residence space 94. If the player piece of a player reaches a City Site space 48, then the player may collect a Spare Parts token 90. The player piece 28 of a player may stop at the City Site even if the number on the die 40 may have indicated they could move beyond the City Site; in other words, the player piece 28 may stop at the City Site if the number apparent on the die 40 would have moved them to a space at least as far along the player-piece spaces path as the City Site is located. If a Spare Parts token 90 is collected, then the token 90 may be examined for its point value and placed, point-value side down, in front of the player who collected the Spare Parts token.

The player piece 28 of a player may also land upon special Conveyor Belt spaces 104. In this case, the player piece 28 of the player may be advanced in a direction indicated by arrows 116 that may be printed on the game-board surface 12*a* next to or on the Conveyor Belt space. The player piece 28 may stop at the player-piece space found at the end of the Conveyor Belt. The net result of a character landing on a Conveyor Belt space may be that the player piece 28 is advanced along the player-piece spaces pathway 16 by more spaces than could have been moved by a roll of the die 40.

Some of the spaces, such as corner spaces 92, upon which a player piece 28 may land, might serve to control the activity of the disruptor 34 provided with the game. For example, a player piece 28 may land, after moving a number of spaces determined by the number on the rolled die 40, on a Reverse Sweeper space 95. Landing on a Reverse Sweeper space may allow a player to change the transit direction of the disrupter upon the game board 10. For example, if the disruptor 34 was originally poised to travel in a clockwise direction around the path of player-piece spaces, then landing on the Reverse Sweeper space may allow a player to orient the disruptor such that its next movement would be in a counterclockwise direction. Landing on a Reverse Sweeper space may not mean that a player may activate the disruptor by depressing the start/stop button 84, it may only mean that the player may change the orientation of the disruptor.

Alternatively or additionally, a player piece controlled by a player may land upon an Advance Sweeper space 96. In this case, the player may control the location of the disruptor 34 by moving it to a new position on the game board 12. For example, landing on the Advance Sweeper space may allow a player to pick up and move the disrupter 34 to the next Sweeper Space, such as a corner space 92 or a space marked with a disruptor icon 100, available in the direction in which the disruptor is pointed. As in the case with the Reverse Sweeper space, landing on an Advance Sweeper space may not mean that a player may activate the disruptor by depressing the start/stop button 84, it may only mean that the player may change the location of the disrupter.

Referring back to the rolling of the die, it is possible that the uppermost face of the rolled die 40 will show a number from 2 to 6. Alternatively, the uppermost side of the rolled die 40 may show a disruptor icon. Rolling the disruptor icon may mean that the person who rolled the die can activate the disruptor 34 and set it traveling upon its circuitous path. Since the motor of the disruptor may already have been wound up, depressing the start/stop button 84 on the body 78 of the disrupter may be sufficient to start the disrupter 34 moving in the direction in which it was pointed. If it was not previously wound up, it may be wound up prior to activating the disruptor. Once the disruptor starts rolling, it may be that the player who activated the disruptor will allow it to stop on its own. Alternatively, the player may elect to stop the disrupter after it makes a full circuit of its track around the board, or half of a circuit, or any other desired distance. Once the disrupter 34 has finished its travels on the game board 12, the player who set the disrupter in motion may move the start/stop button 84 to a stop position on the disruptor, rewind its motor with the winding device 68 and place it on the next disruptor Start space in the direction which the disrupter is currently facing.

As the disruptor 34 moves along the track, it may come into contact with one or more of the player pieces 28 of the players. The rules for the game may contain the provision that any player piece 28, which was hit or touched by the disruptor 34, must return to the last City Site visited by that mover. In addition, it may be that a player who controls a hit or touched player piece 28 may be required to return one of the player's accumulated Spare Parts tokens 90 to the bottom of the Spare Parts tokens pile. If the player does not have any Spare Parts tokens 90, then there may be no further penalty for their player piece 28 being struck or touched by the disrupter 34.

Of note, it may be that not all of the player-piece spaces upon which a player piece 28 may reside are necessarily at risk of being impacted by the disruptor 20. For example, the City Sites of the game board (which may be the differently-sized spaces mentioned at the beginning of this disclosure) may be "safe zones," where the disrupter 34 may not intrude. The game board 12 may be designed such that the circuitous track 42 followed by the disrupter avoids the City Sites.

For example, in FIG. 2, disruptor 34, and therefore pathway 20, may have a width W. When the disrupter travels along pathway 20, the outer edges of which are indicated by dashed lines 118 and 120, it contacts any player piece positioned on the pathway. Thus, player-piece base 114, located entirely within a smaller player-piece space 46' may intersect pathway 20. On the other hand, a player-piece base 114' may be positioned in a larger player-piece space 48' that is spaced from pathway 20. Accordingly, when the disruptor travels along pathway 20 through player-piece space 46', a player piece on space 46' will be contacted by the disruptor. However, when the disrupter travels through space 48', it will not contact a player piece safely positioned away from the disruptor pathway.

By moving their player piece 28 safely along the player-piece pathway 16, visiting the City Sites 48, and accumulating Spare Parts tokens 90, a player may accumulate a plurality of points. If a player successfully avoids the disruptor and accumulates a set number of points, that person may be declared the winner of the game. For example, a player who collects 6 points' worth of Spare Parts tokens 90 during the course of the above-described game may be the victor. At this point, the winning player may turn their Spare Parts cards point-value side up as a way to confirm to the other players the winner's point total.

Accordingly, it will be appreciated that a method of playing a game may include a game board, a plurality of distinctive player pieces and at least one disruptor. The game board may include a player-piece pathway of connecting player-piece spaces and a disrupter pathway extending through at least one set of a plurality of contiguous player-piece spaces. The method may include various actions. For example, the method may include one or more of moving playing pieces along the player-piece pathway in turns; placing at least one playing piece on at least one of the contiguous player-piece spaces; moving the one disruptor along the disrupter pathway and the one contiguous player-piece space; contacting the one playing piece with the one disruptor; and/or penalizing the one playing piece after the one playing piece is contacted by the disrupter.

While embodiments of a game and methods of playing a game have been particularly shown and described, many variations may be made therein. This disclosure may include one or more independent or interdependent inventions directed to various combinations of features, functions, elements and/or properties, one or more of which may be defined in the following claims. Other combinations and sub-combinations of features, functions, elements and/or properties may be claimed later in this or a related application. Such variations, whether they are directed to different combinations or directed to the same combinations, whether different, broader, narrower or equal in scope, are also regarded as included within the subject matter of the present disclosure. Accordingly, the foregoing embodiments are illustrative, and no single feature or element, or combination thereof, is essential to all possible combinations that may be claimed in this or a later application. Each claim defines an invention disclosed in the foregoing disclosure, but any one claim does not necessarily encompass all features or combinations that may be claimed. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

I claim:

1. A game comprising:

a game board having:

a continuous player-piece pathway of consecutive player-piece spaces; and a continuous disruptor pathway separate and distinct along the full length of the disruptor pathway from the player-piece pathway, having a continuous groove without obstructions and extending along the length of the disruptor pathway, and having a first portion spaced from the player-piece pathway, and a second portion following the player-piece pathway and extending through at least one set of a plurality of consecutive player-piece spaces;

a plurality of distinctive player pieces; and at least one disruptor having a guide wheel with an outer edge sized to fit without obstruction into the groove, the disruptor adapted to travel along the disruptor pathway with the guide wheel outer edge moving without obstruction in the groove, the disruptor, disruptor pathway and the player-piece pathway being configured such that the disruptor follows the player-piece pathway, passing successively from one player-piece space to the next player-piece space while moving along the second portion.

2. The game of claim 1, in which the groove and guide wheel are configured to maintain the disruptor on the disruptor pathway as the disruptor moves along the disruptor pathway with the guide-wheel outer edge in the groove and contact a player piece located on a player-piece space in the one set of player-piece spaces.

3. The game of claim 1, in which the groove and guide wheel are configured to maintain the disruptor on the disruptor pathway when the disruptor moves selectively along the disruptor pathway with the guide-wheel outer edge moving freely in the groove in a first direction and in a second direction opposite to the first direction.

4. The game of claim 3, in which the disruptor includes a drive mechanism that moves the disruptor in a single direction, and the disruptor moves along the disruptor pathway when the single direction is aligned with a selected one of the first direction and the second direction with the guide-wheel outer edge in the groove.

5. The game of claim 1, in which the plurality of player pieces, the disruptor, and player-piece spaces in the set of player-piece spaces have dimensions appropriate to cause the disruptor traveling along the disruptor pathway to contact a player piece positioned within one of the player-piece spaces in the set of player-piece spaces.

6. The game of claim 5, in which at least one of the player-piece spaces is an enlarged space sized to receive a player piece in a position in which the received player piece will not be contacted by the disruptor traveling along the disruptor pathway.

7. The game of claim 1, in which the one set has at least three consecutive player-piece spaces.

8. The game of claim 1, in which the guide wheel supports the disruptor when the disruptor is positioned on the disruptor pathway with the guide wheel positioned in the groove.

9. The game of claim 1, in which the groove intersects itself in a loop.

10. A game comprising:

a game board having:

a continuous player-piece pathway of consecutive player-piece spaces; and a disruptor pathway having a continuous unobstructed groove, the groove extending through at least one player-piece space;

a plurality of distinctive player pieces; and a disruptor including a body and a guide wheel supporting and extending from the body, the guide wheel having an outer edge to be received without obstruction in the groove, the groove allowing unobstructed movement of the disruptor in either of two opposite directions along the disruptor pathway while the guide-wheel outer edge moves without obstruction in the groove;

the disruptor, the plurality of player pieces, and the player-piece spaces in the sets of player-piece spaces, being configured so that the disruptor traveling along the disruptor pathway contacts a player piece positioned on the one player-piece space.

11. The game in claim 10, wherein the groove extends through a plurality of consecutive player-piece spaces.

12. The game of claim 10, in which the groove intersects itself in a loop.

13. A method of playing a game having a game board, a plurality of distinctive player pieces and at least one disruptor with a guide element, the game board including a player-piece pathway of consecutive player-piece spaces and a disruptor pathway having a continuous groove along the length of the disruptor pathway, the groove configured to freely receive the guide element, the disruptor pathway having a first portion spaced from the player-piece pathway, and a second portion following the player-piece pathway and extending through at least one set of a plurality of consecutive player-piece spaces, the method comprising:

moving playing pieces of respective players along the player-piece pathway by players taking turns;

during one of the turns, placing at least one playing piece on at least one of the player-piece spaces in the one set of consecutive player-piece spaces;

during a turn subsequent to the one turn, positioning the disruptor in a first orientation on the disruptor pathway with the guide element in the groove, and then moving the one disruptor along the first and second portions of the disruptor pathway in a first direction with the guide element moving in the groove, including the one player-piece space, with the disruptor following the player-piece pathway, passing successively from one player-piece space to the next player-piece space, during movement through the one set of player-piece spaces;

while moving the disruptor along the second portion of the disruptor pathway with the guide element in the groove, contacting the one playing piece with the one disruptor;

penalizing the player having the one playing piece after the one playing piece is contacted by the disruptor; and during a turn subsequent to the turn subsequent to the one turn, reversing the orientation of the disruptor on the disruptor pathway, and then moving the one disruptor along the disruptor pathway in a second direction opposite to the first direction with the guide element moving in the groove.

14. The method of claim 13, wherein moving the one disruptor is performed in response to instructions to move the disruptor received by a player during one of the player's turns.

15. The method of claim 13, wherein moving the one disruptor includes moving the one disruptor along the disruptor path a distance determined by the player.

16. The method of claim 13, wherein moving the one disruptor includes moving the one disruptor along the disruptor pathway and leaving the disruptor at an end location.

17. The method of claim 16, wherein moving the one disruptor includes moving the one disruptor along the disruptor pathway from the end location.

18. The method of claim 13, wherein moving the one disruptor includes moving the one disruptor from an existing location to one of a plurality of given locations on the disruptor pathway.

19. The method of claim 13, wherein moving playing pieces includes moving one of the playing pieces to a position on a playing-piece space where the disruptor misses the one playing piece during travel along an adjacent stretch of the disruptor pathway.

20. The method of claim 19, wherein the player having the one playing piece receives an award when the one playing piece is moved to the position.

* * * * *